United States Patent [19]

Wu

[11] Patent Number: 5,060,684

[45] Date of Patent: Oct. 29, 1991

[54] AUTOMATIC UMBRELLA FOLDABLY RETAINED BY TIP CAP

[76] Inventor: Tsun-Zong Wu, No. 16, Chen-Tai Road, Sect. 3, Wu-Ku Hsiang, Taipei Hsien, Taiwan, 24801

[21] Appl. No.: 580,185

[22] Filed: Sep. 10, 1990

[51] Int. Cl.[5] ..... A45B 23/00

[52] U.S. Cl. ..... 135/25.41; 135/24; 135/44

[58] Field of Search ..... 135/22–24, 135/20 TH, 37, 44, 38–41

[56] References Cited

U.S. PATENT DOCUMENTS

| | | | |
|---|---|---|---|
| 1,878,428 | 9/1932 | Rose | 135/44 |
| 3,625,236 | 12/1971 | Hayano | 135/22 |
| 3,658,077 | 4/1972 | Sato | 135/22 |
| 3,856,030 | 12/1974 | Sato | 135/24 X |
| 4,548,222 | 10/1985 | Day | 135/24 |
| 4,802,499 | 2/1989 | Lisack | 135/22 X |
| 4,936,332 | 6/1990 | Wu | 135/24 X |

FOREIGN PATENT DOCUMENTS

| | | | |
|---|---|---|---|
| 972435 | 7/1959 | Fed. Rep. of Germany | 135/44 |
| 2309223 | 8/1974 | Fed. Rep. of Germany | 135/22 |
| 619692 | 3/1949 | United Kingdom | 135/44 |

*Primary Examiner*—David A. Scherbel
*Assistant Examiner*—Lan Mai

[57] ABSTRACT

An automatic umbrella includes a plurality of ribs respectively pivotally secured to a plurality of ferrules respectively mounted or held on a telescopic central shaft, an opening tensioning spring formed in the central shaft for opening the umbrella, at least a retraction restoring spring for closing the umbrella, and a tip cap slidably mounted on a grip, in which the tip cap may be operated for depressing a biasing lever for disengaging a lower ferrule pivotally linked with the ribs for opening the umbrella, and may be further operated for depressing a sliding latch for releasing an elastic force of the opening tensioning spring to allow a restoring operation acted by the retraction restoring springs for closing the umbrella from its opening state.

5 Claims, 7 Drawing Sheets

AUTOMATIC UMBRELLA FOLDABLY RETAINED BY TIP CAP

BACKGROUND OF THE INVENTION

Day disclosed an automatic single push button type umbrella in his U.S. Pat. No. 4,823,821 which is expanded by spring action and collapsed by spring action. Both spring actions are initiated by a single push button which is manually manipulated in the same manner for initiating both spring actions.

Besides a false operation possibly being made by Day's umbrella, for instance, a suddenly continuous depression of the button 6 or uncareful push button operation which may first open the umbrella and then close the umbrella quickly, Day's umbrella did not provide any means for holding the tips of rib assembly 5 towards the shaft 3 approximate to the grip 31 when the umbrella is closed. There is no suitable space for providing a tip cap slidably held on the cylindrical wall 35 of the grip 31 for fastening the folded tips of rib 5 so that the ribs 5 even after being collapsed may still be slightly extended as shown in his FIG. 1, possibly obstructing an environmental object or even stick and injure the user or someone standing nearby especially on a crowded city bus.

The present inventor has found the drawbacks of such a conventional automatic umbrella, and invented the present automatic umbrella which is foldably retained by a tip cap.

SUMMARY OF THE INVENTION

The object of the present invention is to provide an automatic umbrella including a plurality of ribs respectively pivotally secured to a plurality of ferrules respectively mounted or held on a telescopic central shaft, an opening tensioning spring formed in the central shaft for opening the umbrella, at least a retraction restoring spring for closing the umbrella, and a tip cap slidably mounted on a grip for controlling the extension of the ribs and the opening of the umbrella, or for controlling the retraction of the ribs and closing of the umbrella.

DETAILED DESCRIPTION

Figure 1:
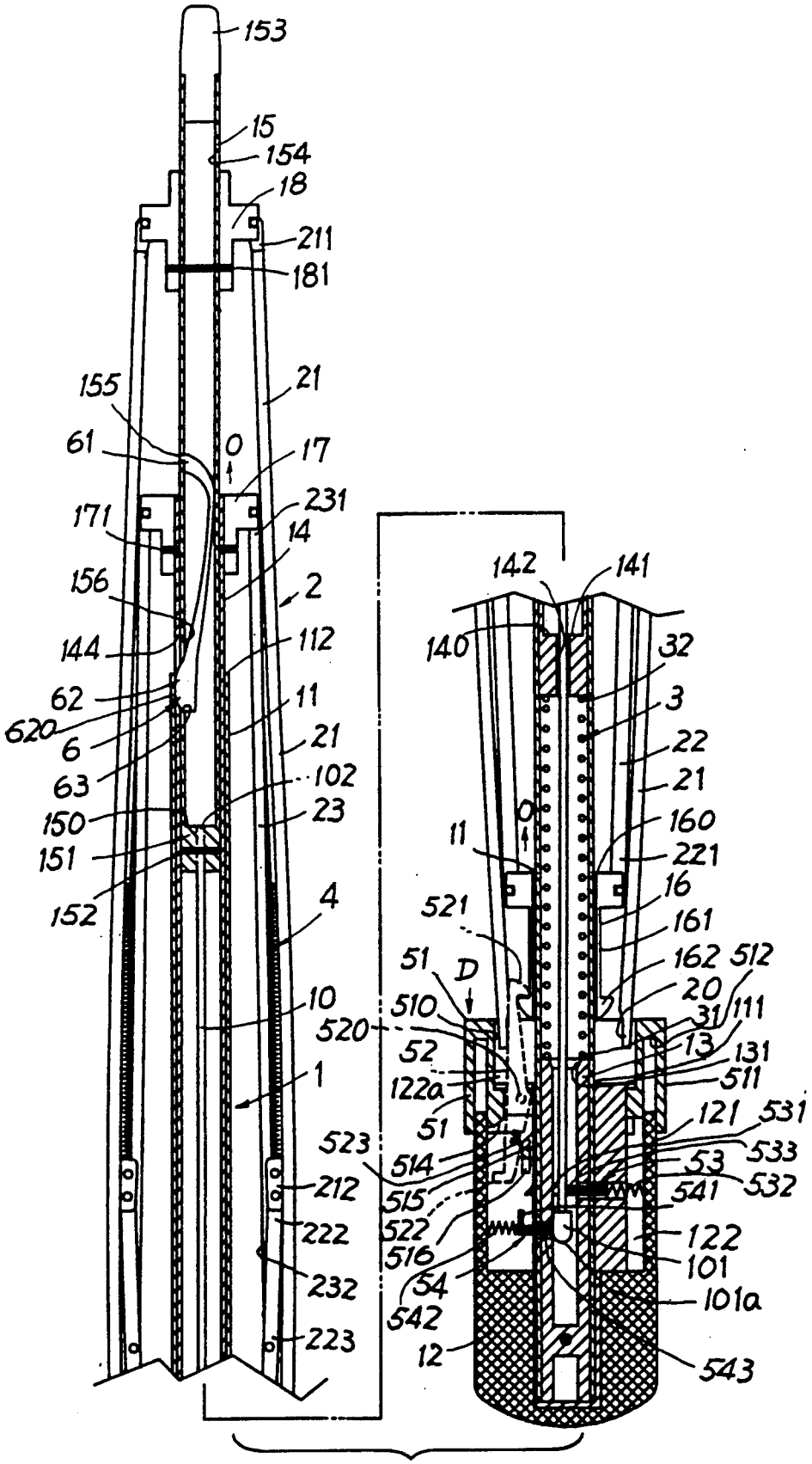
FIG. 1 is an illustration showing a folded umbrella of the present invention.
Figure 2:
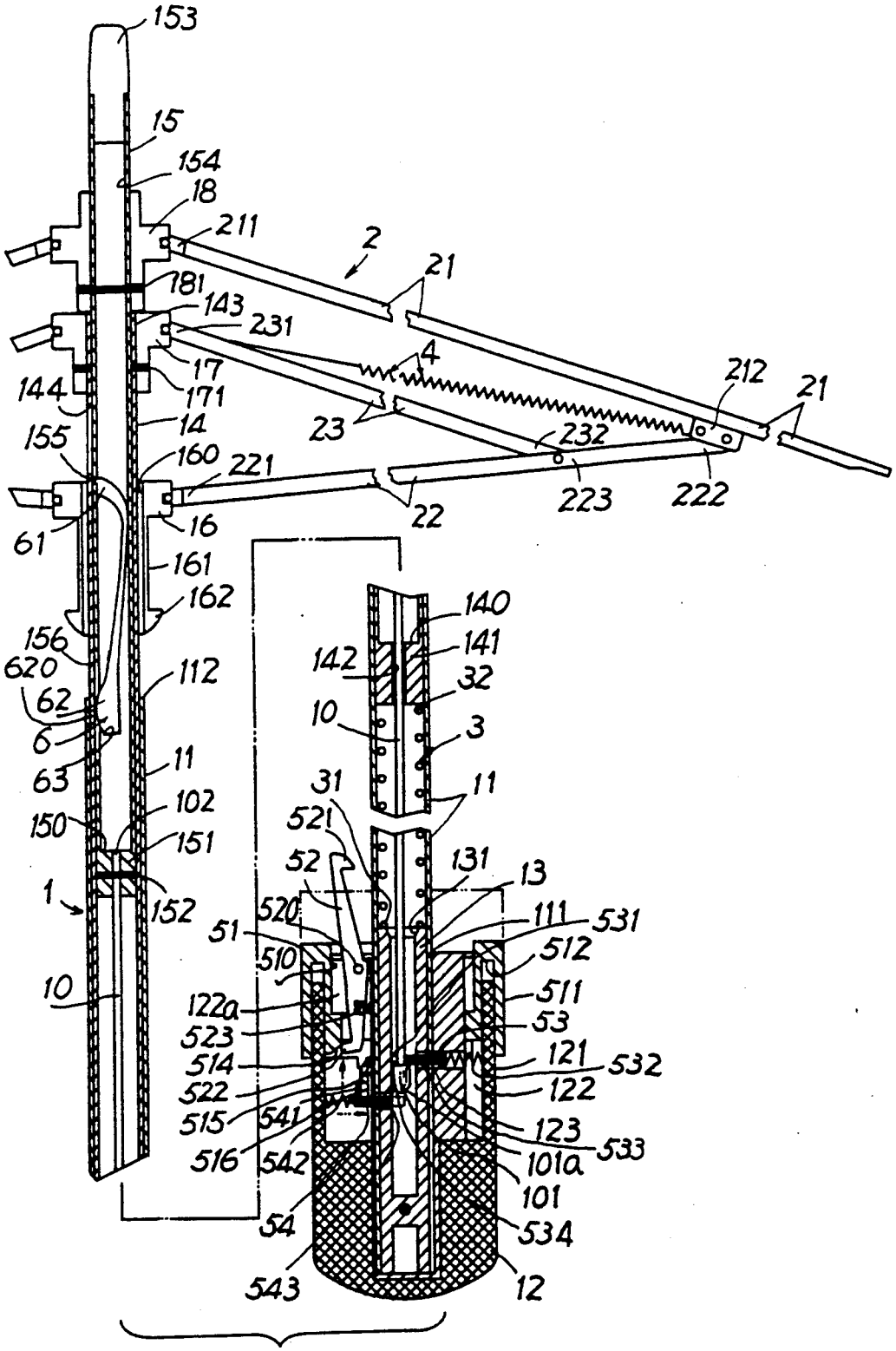
FIG. 2 shows an opening umbrella of the present invention.
Figure 3:
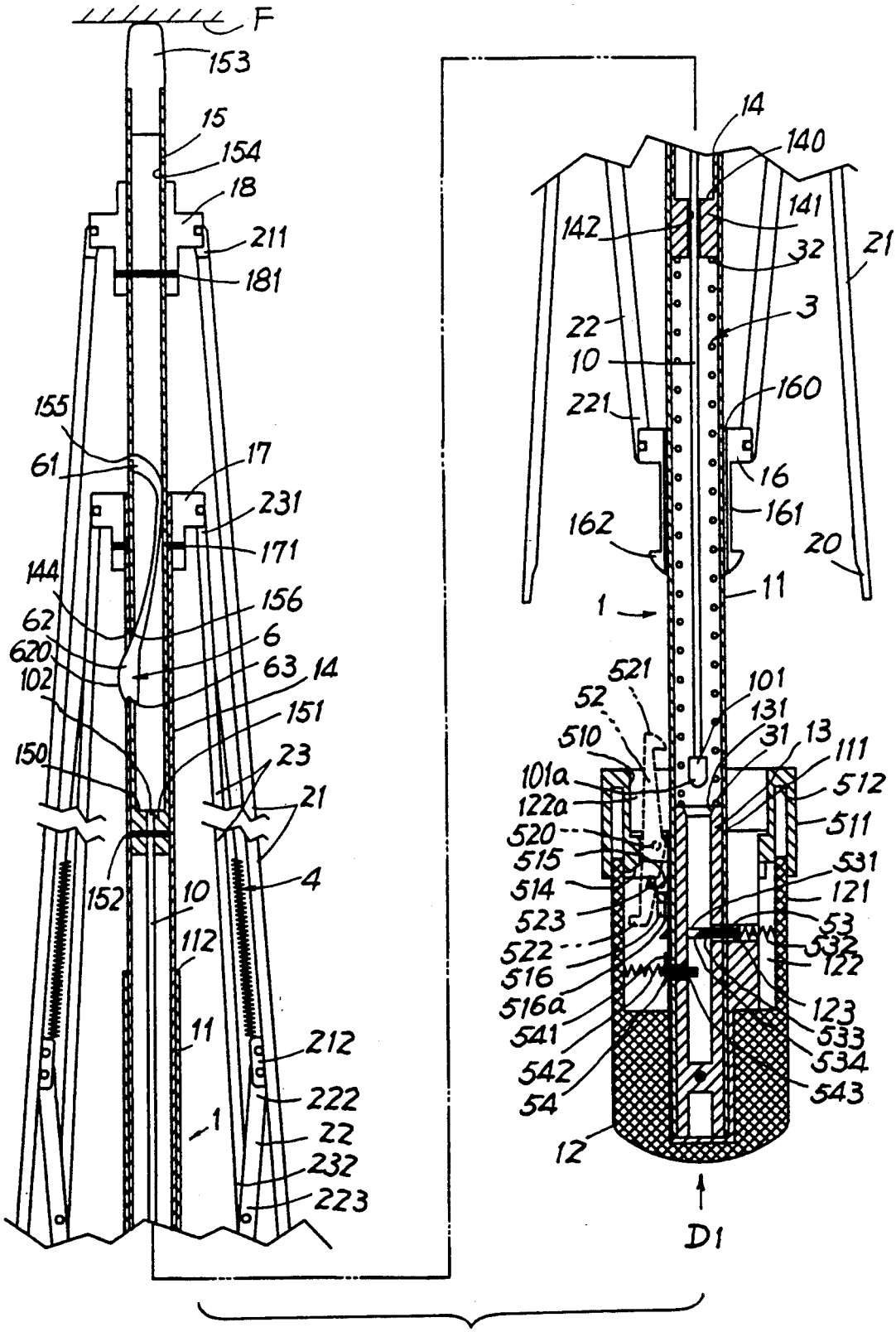
FIG. 3 shows a folded umbrella of the present invention when foldably restored from FIG. 2.

As shown in FIGS. 1–3, the present invention comprises: a central shaft means 1, a rib assembly 2 for securing an umbrella cloth thereon, an opening tensioning spring 3 for opening the umbrella, at least a retraction restoring spring 4 for closing the umbrella, a control means 5 for the control of opening or closing operation of the umbrella, and a spring catch 6 resiliently coupling two tubular shafts of the central shaft means 1.

The central shaft means 1 includes: a lower tubular shaft 11, a grip 12, a lower sleeve tube 13 fixed in a lower portion of the lower shaft 11, a middle tubular shaft 14 telescopically mounted in the lower shaft 11, an upper tubular shaft 15 telescopically mounted in the middle shaft 14, a lower ferrule 16 slidably held on the central shaft means 1, a middle ferrule 17 fixed on an upper end portion 143 of the middle shaft 14 by a pin 171, and an upper ferrule 18 secured on an upper end portion 154 of the upper shaft 15 by a pin 181.

The lower tubular shaft 11 has its lower portion 111 inserted in a central shaft hole formed in the grip 12. The lower sleeve 13 includes an upper taper opening 131 for smoothly guiding a locking head 101 of a central rod 10 formed in the central shaft means 1 into the lower sleeve 13.

The central rod 10 includes a locking head 101 having taper bottom portion 101*a* formed on a lowermost end of the rod 10, and an upper end portion 102 secured with an upper plug 151 which is secured on a lower portion 150 of the upper shaft 15 by a pin 152.

The middle plug 141 is formed with a central rod hole 142 for freely passing the rod 10 when operating the umbrella of the present invention. The plug 141 is formed on a lower portion of the middle shaft 14 for retaining an upper spring end portion 32 of the tensioning spring 3.

The rib assembly 2 includes at least a top rib 21 having its inner end portion 211 pivotally secured to the upper ferrule 18, at least a stretcher rib 22 having an inner end portion 221 pivotally secured to the lower ferrule 16 and having an outermost end portion 222 pivotally secured to an outer portion 212 such as a lug secured to the top rib 21 as shown in FIG. 2, and at least an intermediate linking rib 23 having an inner end portion 231 pivotally secured to the middle ferrule 17 and having an outer end portion 232 pivotally connected with an outer portion 223 of the stretcher rib 22. The retraction restoring spring 4 is secured between the middle ferrule 17 and the outer portion or a pivotal joint 212 pivotally connecting the stretcher rib 22 with the top rib 21 for resiliently folding the ribs 2 towards the central shaft means 1 when closing the umbrella of the present invention. Other locations or modifications of the restoring spring 4 may be made on the rib 2 in accordance with the present invention. The lower ferrule 16 includes a cylindrical sleeve 161 having a central hole 160 formed therein for freely moving on the lower shaft 11 and the middle shaft 14, and an extension ring 162 tapered downwardly to be engaged with a hook portion 521 of the control means 5. A central head portion 153 is formed on a top portion of the upper shaft 15.

The control means 5 includes: a tip cap actuator 51, an opening controller 52 for controlling the extension of the ribs 2 and the opening of the umbrella, a closing controller 53 for the control of the retraction of the ribs and closing of the umbrella, and an intermediate positioner 54 for preventing a false closing operation when opening the umbrella.

Figure 4:
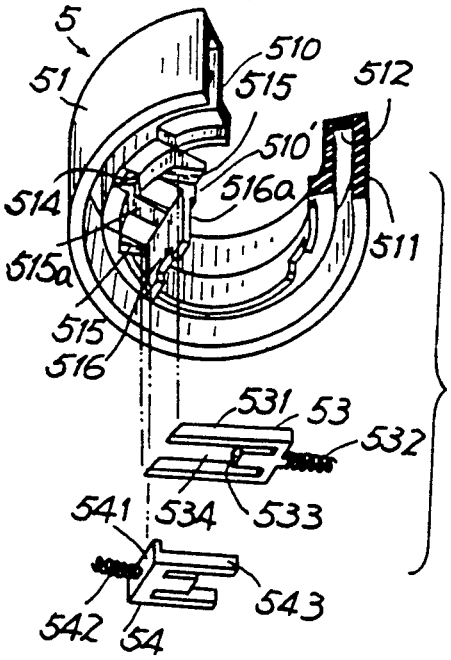
FIG. 4 shows a control means of the present invention.
Figure 6:
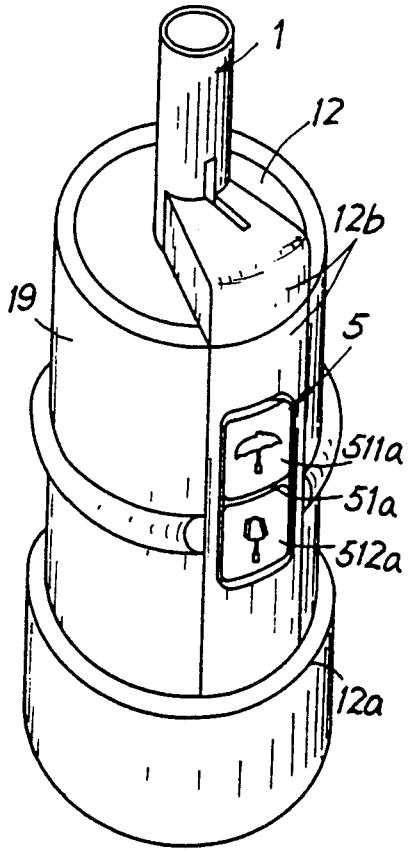
FIG. 6 shows another preferred tip cap of the present invention, mounted on the grip.
Figure 5:
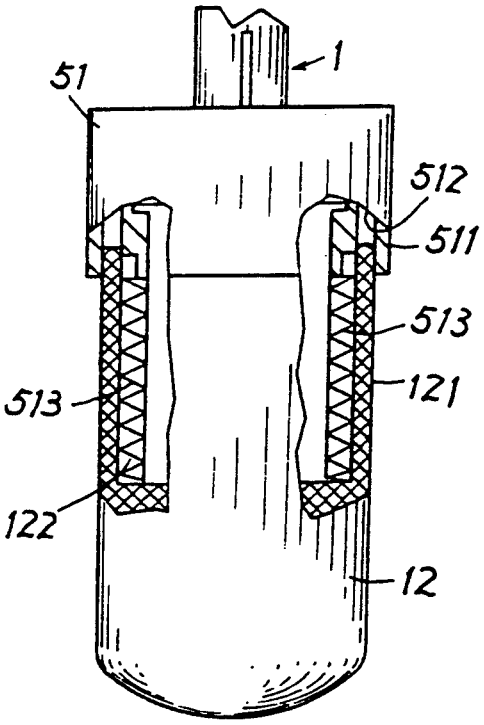
FIG. 5 shows a tip cap resiliently held on a grip of the present invention.
Figure 7:
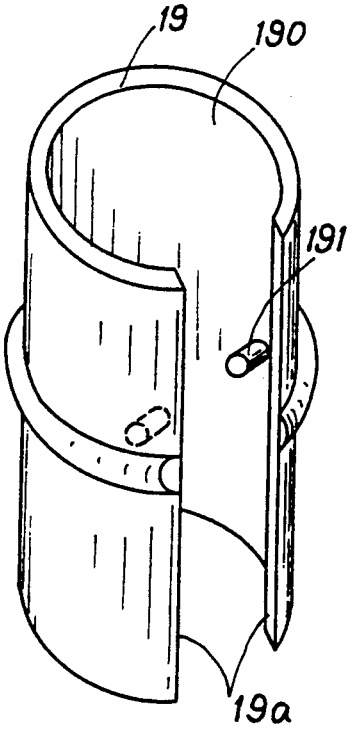
FIG. 7 shows the tip cap of FIG. 6 in accordance with the present invention.

The tip cap actuator 51 includes a double cylindrical-wall sleeve 511 having an annular groove 512 formed therein to be slidably engageable with a cylindrical wall 121 formed in the grip 12, a sleeve tensioning spring 513 retained in a socket 122 defined within the wall 511 for normally urging the sleeve 511 upwardly, a first sloping surface 514 tapered downwardly outwardly formed on an inner lower periphery of the sleeve 511 for operatively depressing a protrusion 522 of the opening controller 52, a second sloping surface 515 formed on a central ring 510' slidably engageable with the central shaft means 1 under the first sloping surface 514 and tapered downwardly outwardly to operatively depress a sliding latch 531 of the closing controller 53, and a lower retarding plate 516 protruding downwardly from the central ring 510' to be retarded by the intermediate positioner 54 as shown in FIG. 4.

The opening controller 52 generally formed as a biasing lever has its middle portion pivotally secured in an upper socket 122*a* in the grip 12 by a pin 520, its upper portion formed as a hook portion 521 engageable with the extension ring 162 of lower ferrule 16 and its lower portion formed as a depression protrusion 522 resiliently retained by an upper spring 523 secured in the grip 12 and operatively depressed by the first sloping surface 514 of the tip cap actuator 51. The spring 523 normally urges the lower depressing protrusion 522 outwardly to bias the upper hook portion 521 inwardly to engage the extension ring 162 of the ferrule 16.

The closing controller 53 includes: a sliding latch 531 as shown in FIG. 4 transversely sliding in a lateral slot 123 formed in the grip 12 and resiliently held in the slot 123 by a middle spring 532 which urges the sliding latch 531 towards the controller 52, having a tongue plate 533 for normally locking a locking head 101 formed on a lower end portion of the central rod 10. The tongue plate 533 is recessed from an outer portion of latch 531 to form a notch 534 as shown in FIG. 4. The central rod 10 is slidably held in the shaft means 1 having the lower locking head 101 having a diameter larger than that of the rod 10 with a taper portion 101*a* formed on its lowest end portion.

The intermediate positioner 54 having a longitudinal section of L shape as shown in FIG. 4 includes a vertical thin plate 541, a lower spring 542 retained on the wall 511 normally urging the positioner 54 towards a center of the grip 12 and a horizontal latch 543 protruding inwardly to be retarded by the locking head 101 when folding the umbrella as shown in FIG. 1.

The sliding latch 531 of the closing controller 53 may be formed as a U shape as shown in FIG. 4 for passing the retarding plate 516 when opening the umbrella as shown in FIG. 2. The second sloping surface 515 as shown in FIGS. 4, 2 is essentially bifurcated to operatively depress the U shaped sliding latch 531 and also to define a central slit 515*a* for passing the biasing lever of the opening controller 52 as shown in FIGS. 1, 2.

The spring catch 6 generally formed as an elongate spring plate includes an upper portion 61 fixed on the upper shaft 15, an arcuate catch portion 62 formed on a lower portion of the spring plate resiliently engageable with an inner catch hole 156 formed in the upper shaft 15 and an outer catch hole 144 formed in the middle shaft 14, and an obtuse-angle block 63 formed on a lowermost portion of the spring plate operatively coupling the middle shaft 14 and the upper shaft 15 having an arcuate line 620 emerging from the obtuse-angle block 63 to form the arcuate catch portion 62 to be operatively depressed inwardly by an upwardly moving of an upper end portion 112 of the lower shaft 11 when depressing the grip 12(D1) for retracting the central shaft means 1 and storing the elastic energy of the spring 3 from FIG. 3 to FIG. 1.

The automatic umbrella as shown in FIG. 1 is closed by folding the ribs towards the central shaft means 1 in which the stretcher rib 22 and lower ferrule 16 are pulled downwardly and the middle ferrule 17, the intermediate rib 21, the middle shaft 14 and the top rib 21 are pulled downwardly along the shaft means 1 to compress the tensioning spring 3 to store its elastic potential energy until the extension ring 162 of the lower ferrule 16 is engaged with the hook portion 521 of the control means 5 for stabilizing a folded umbrella as shown in FIG. 1.

When it is intended to open the umbrella from FIG. 1 to FIG. 2, the tip cap actuator 51 is depressed downwardly(D) to depress the protrusion 522 inwardly to bias the hook portion 521 outwardly to disengage the extension ring 162 of ferrule 16 so that the tensioning spring 3 will release its elastic energy to extend the spring 3, the middle shaft 14 to raise the middle ferrule 17 and extend the ribs 23, 22, 21 (direction 0) for opening the umbrella as shown in FIG. 2. During the extending of the ribs 21, 22, 23, the retraction restoring spring 4 is tensioned between the two ferrules 18, 17 to store its elastic potential energy which tends to urge the middle ferrule 17, the lower ferrule 16 and the pivotally connected ribs 2 downwardly in order to restore the retraction of the ribs 2, but is retarded by the tensioning spring 3 retained between the plug 141 and the latch 531 thereby stably keeping an opening umbrella.

During the opening of the present umbrella, the locking head 101 as shown in FIG. 1 is downwardly positioned to retard the inward poking of the horizontal latch 543 of the intermediate positioner 54 so that upon the downward depression of the tip cap 51 the lower retarding plate 516 is limited by the latch 543 as shown in FIG. 2 for obstructing further depression of the sliding latch 531 of the closing controller 53 for preventing a falsely unexpected closing operation immediately after the opening operation of the umbrella.

From FIG. 1 to FIG. 2, the locking head 101 will be upwardly moved by the extension of spring 3 when opening the umbrella to no longer retard the horizontal latch 543 of the positioner 54 so that the latch 543 will be protruded inwardly as dotted line shown in FIG. 2 to allow the vertical thin plate 541 to reach a tubular wall of the lower shaft 11, allowing a further downwardly moving of the retarding plate 516 when closing the umbrella as hereinafter described.

After releasing the depression of tip cap 51, the tip cap 51 will be restored upwardly by spring 513 as shown in dotted line of FIG. 2. Now further depressing the tip cap 51, the second sloping surface 515 will depress the sliding latch 531 inwardly to disengage the locking head 101 to release the remaining elastic force of the spring 3 so that the retraction restoring springs 4 will restore to lower the ferrules 17, 16 to retract the ribs 23, 22, 21 towards the central shaft means 1 to close the umbrella from FIG. 2 to FIG. 3. The retarding plate 516 is slightly separated from the tubular wall of shaft 11 at numeral 516*a* to be not collided by the vertical plate 541 of the positioner 54 when depressing the tip cap 51 in FIG. 2.

Figure 1A:
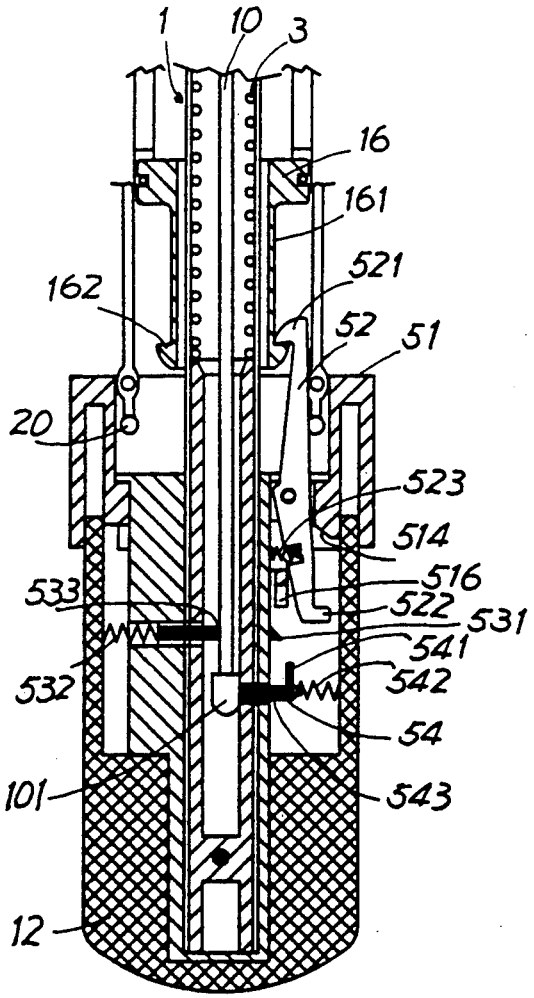
FIG. 1*a*--1*e* show the steps for opening and closing the umbrella of the present invention.
Figure 1B:
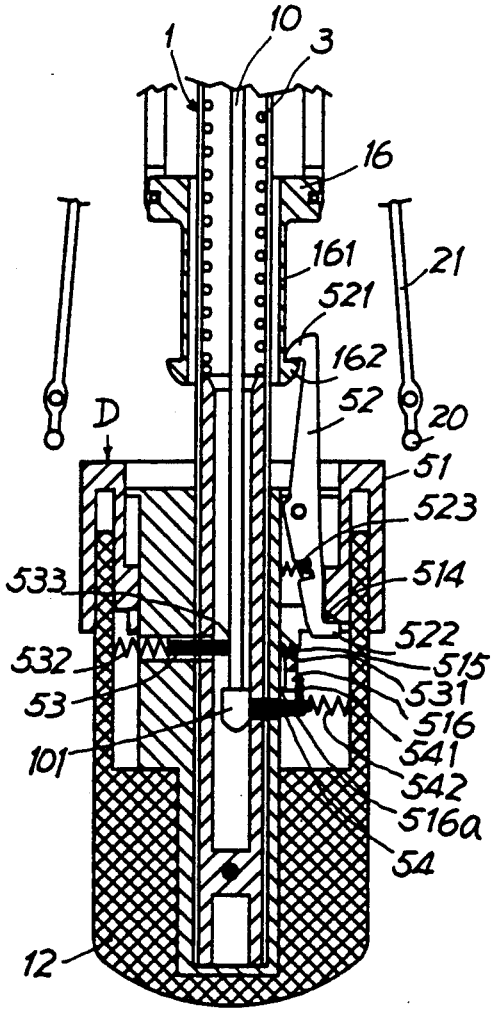
Figure 1C:
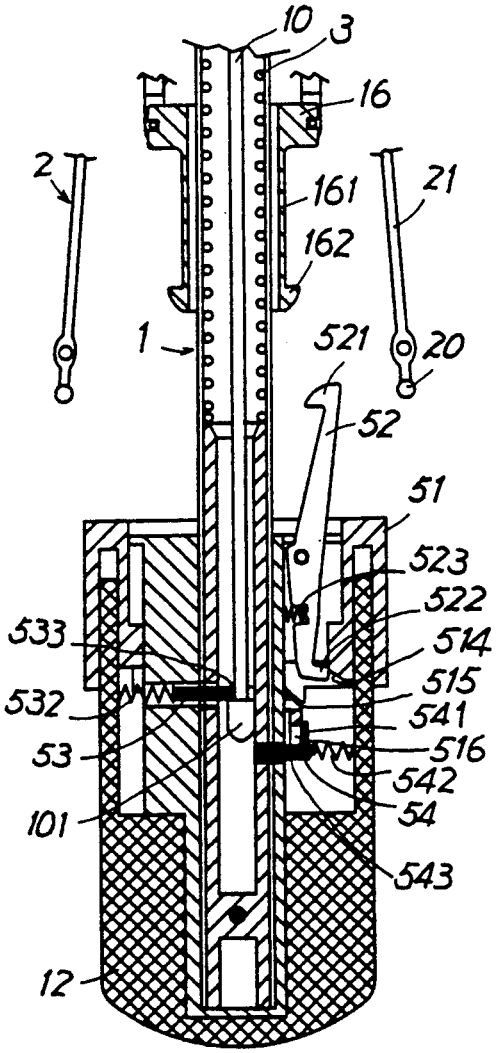
Figure 1D:
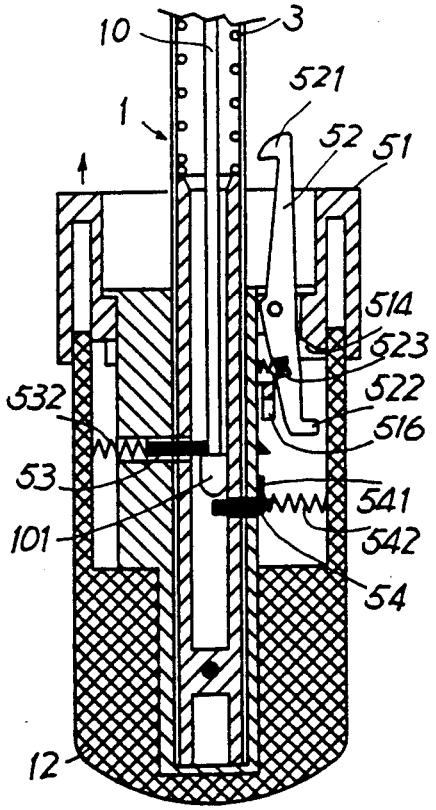
Figure 1E:
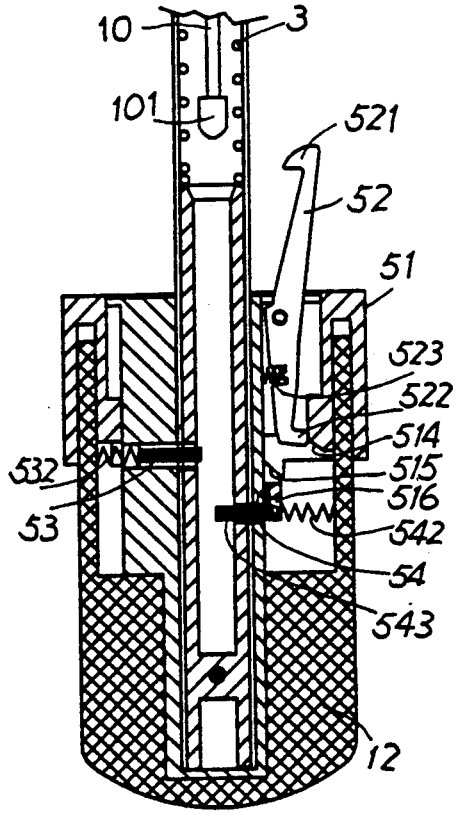

The present invention can be further illustrated in FIG. 1*a*–1*e* for stepwise showing the opening and closing sequences of the umbrella, in which, FIG. 1*a* shows the folded umbrella; FIG. 1*b* showing the depression (D) of tip cap 51 for releasing the rib tips 20; FIG. 1*c* showing the initiation for opening the umbrella, FIG. 1*d* showing re-rising of tip cap 51 ready for next closing operation from an opened umbrella as shown in FIG. 2, and FIG. 1*e* showing the depression of tip cap for closing the umbrella. FIGS. 1*a*–1*e* may be also referred to FIGS. 1–3. In FIGS. 1*a*–1*e*, the tip 20 of umbrella rib 2 has been modified to be a ball type from the aforementioned taper tip.

The grip 12 is depressed against the head portion 153 on the upper shaft 15 (D1) to compress the tensioning spring 3 as retained between a lower tube 13, and a middle plug 141 to store an elastic potential energy of the spring 3 until the tapered bottom portion 101*a* of the locking head 101 is engaged with the tongue plate 533 resiliently held in grip 12 by spring 532, thereby folding the umbrella of the present invention ready for next opening operation as shown in FIG. 1. Since the obtuse-angle block 63 couples the shafts 14 and 15, the depression of grip 12 will thus compress the spring 3 until the hook portion 521 is engaged with the ring entension 162 as shown in FIG. 1, whereby the upper end 112 of lower shaft 11 will also depress the catch portion 62 inwardly allowing a next opening operation of the umbrella.

The present invention is superior to the prior art with the advantages of: a stable folding for locking the lower ferrule 16 towards the grip 12 and for fastening the tips 20 of ribs 2 within the sleeve 511 of the tip cap 51 to prevent an unexpected opening of the ribs; and also for preventing a false closing operation when opening the umbrella.

Figure 8:
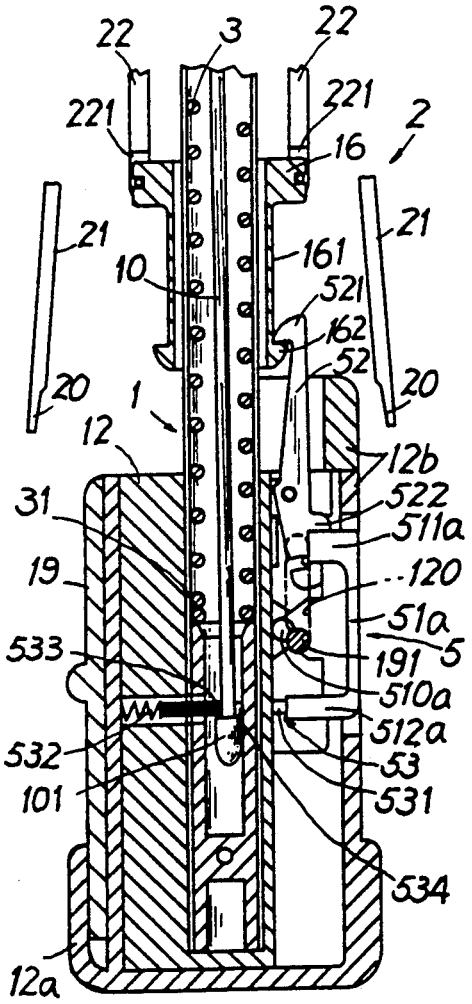
FIG. 8 shows a downwardly retracted tip cap of the present invention.
Figure 9:
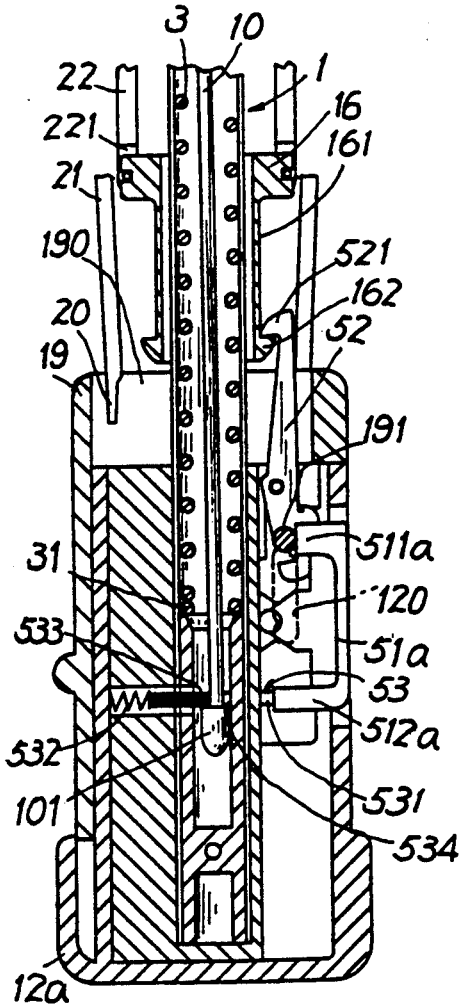
FIG. 9 shows an extended tip cap of the present invention.

As shown in FIGS. 6–9, a tip cap 19 generally cylindrical shaped may be disposed around the grip 12, which includes a side notch 19*a* slidably engaged with an elongate base portion 12*b* which is formed on the grip 12 for providing a push button 51*a* of the control means 5 therein, and two protrusions 191 formed inside the cap 19 to be adjustably engaged with two elongate slots 120 formed in the grip 12 (FIGS. 8, 9). The tip cap 19 is slidably held in a bottom sleeve 12*a* formed on a bottom portion of the grip 12. The tip cap 19 can be pulled upwardly from FIG. 8 to shield plural tips 20 of the umbrella ribs 2 within a socket 190 defined by the cap 19 as shown in FIG. 9.

In such a preferred embodiment, the aforementioned tip cap 51 as shown in FIGS. 1–5 has now been substituted with a push button 51*a* pivotally mounted by a pin 510*a* in the grip 12, having an upper lever 511*a* operatively depressing the opening controller 52 and a lower lever 512*a* operatively depressing the closing controller 53. The positioner 54 is now eliminated.

I claim:

1. An automatic umbrella comprising:

a central shaft means including a lower shaft having a grip secured on a lower portion of said lower shaft, a middle tubular shaft telescopically mounted in said lower tubular shaft having a middle plug formed on a lower end portion of said middle tubular shaft, and an upper tubular shaft mounted in said middle tubular shaft having an upper plug fixed on a lower end portion of said upper tubular shaft;

a rib assembly including at least a top rib having an inner end portion of said top rib pivotally secured to an upper ferrule fixed on an upper end portion of said upper tubular shaft, at least a stretcher rib having an inner end portion of said stretcher rib pivotally secured to a lower ferrule slidably held on said central shaft means and having an outer portion of said stretcher rib pivotally secured to said top rib, and at least an intermediate linking rib pivotally secured between said stretcher rib and a middle ferrule fixed on an upper end portion of said middle tubular shaft;

an opening tensioning spring formed in said central shaft means for opening said umbrella having an upper spring end portion retained on said middle plug of said middle shaft and having a lower spring end portion retained on a lower sleeve tube inserted in the grip;

a central rod formed in said central shaft means having a locking head formed on a lower portion of said rod and having an upper end portion of said rod secured to said upper plug of said upper shaft, said rod passing said middle plug of said middle shaft;

at least a retraction restoring spring each secured between said middle ferrule and an outer portion of said rib assembly for retracting said rib assembly when closing said umbrella;

a control means formed in said grip having a tip cap actuator slidably mounted on said grip for operatively depressing an opening controller for opening the automatic umbrella, or depressing a closing controller for closing the umbrella, said closing controller having a sliding latch resiliently slidably retained in said grip for normally locking said locking head of said central rod when opening the umbrella;

said lower ferrule having an extension ring formed on a lower portion of said lower ferrule engageable with an upper hook portion of said opening controller for pulling lower and middle ferrules and said rib assembly downwardly along said central shaft means for retracting said rib assembly for compressing said tensioning spring for storing its elastic potential energy, and upon a disengagement of said extension ring of said lower ferrule from said hook portion of said opening controller, said tensioning spring will be restored to raise said middle shaft and said middle ferrule for extending said rib assembly for opening said umbrella;

said control means including an intermediate positioner resiliently retained in said grip having a vertical thin plate and a horizontal latch normally protruding towards a center of said grip, said positioner operatively retarding a downward depression of said tip cap actuator when opening the umbrella for preventing a false closing operation after opening the umbrella; and said tip cap actuator including a double-cylindrical-wall sleeve having an annular groove formed therein to be slidably engageable with a cylindrical wall formed in the grip, a sleeve tensioning spring retained in a socket defined within the wall for normally urging the sleeve upwardly, a first sloping surface tapered downwardly outwardly formed on an inner periphery of the sleeve for operatively depressing a protrusion formed on a lower portion of the opening controller resiliently pivotally mounted in the grip for biasing said hook portion of said opening controller for opening the umbrella, a second sloping surface formed on a central ring slidably engageable with the central shaft means under the first sloping surface and tapered downwardly outwardly to operatively depress the slide latch of the closing controller for closing the umbrella, and a lower retarding plate protruding downwardly from the central ring of the sleeve to be retarded by the intermediate positioner of said control means when opening the umbrella.

2. An automatic umbrella according to claim 1, wherein said upper tubular shaft and said middle tubular shaft are operatively coupled by a spring catch, whereby upon a depression of said grip for compressing said opening tensioning spring against said upper tubular shaft.

3. An automatic umbrella according to claim 2, wherein said spring catch generally formed as an elongate spring plate includes an upper portion of said spring plate fixed on the upper shaft, an arcuate catch portion formed on a lower portion of the spring plate resiliently engageable with an inner catch hole formed in the upper shaft and an outer catch hole formed on the middle shaft, and an obtuse-angle block formed on a lowermost portion of the spring plate operatively coupling said middle shaft and said upper shaft having an arcuate line emerging from said obtuse-angle block to form the arcuate catch portion to be operatively depressed inwardly by an upwardly moving of an upper end portion of the lower shaft when depressing the grip for retracting the central shaft means and storing the elastic energy of the tensioning spring.

4. An automatic umbrella comprising:

a central shaft means including a lower shaft having a grip secured on a lower portion of said lower shaft, a middle tubular shaft telescopically mounted in said lower tubular shaft having a middle plug formed on a lower end portion of said middle tubular shaft, and an upper tubular shaft mounted in said middle tubular shaft having an upper plug fixed on a lower end portion of said upper tubular shaft;

a rib assembly including at least a top rib having an inner end portion of said top rib pivotally secured to an upper ferrule fixed on an upper end portion of said upper tubular shaft, at least a stretcher rib having an inner end portion of said stretcher rib pivotally secured to a lower ferrule slidably held on said central shaft means and having an outer portion of said stretcher rib pivotally secured to said top rib, and at least an intermediate linking rib pivotally secured between said stretcher rib and a middle ferrule fixed on an upper end portion of said middle tubular shaft;

an opening tensioning spring formed in said central shaft means for opening said umbrella having an upper spring end portion retained on said middle plug of said middle shaft and having a lower spring end portion retained on a lower sleeve tube inserted in the grip;

a central rod formed in said central shaft means having a locking head formed on a lower portion of said rod and having an upper end portion of said rod secured to said upper plug of said upper shaft, said rod passing said middle plug of said middle shaft;

at least a retraction restoring spring each secured between said middle ferrule and an outer portion of said rib assembly for retracting said rib assembly when closing said umbrella;

a control means formed in said grip having a tip cap slidably mounted on said grip for operatively depressing an opening controller for opening the automatic umbrella, or depressing a closing controller for closing the umbrella, said closing controller having a sliding latch resiliently slidably retained in said grip for normally locking said locking head of said central rod when opening the umbrella;

said lower ferrule having an extension ring formed on a lower portion of said lower ferrule engageable with an upper hook portion of said opening controller for pulling lower and middle ferrules and said rib assembly downwardly along said central shaft means for retracting said rib assembly for compressing said tensioning spring for storing its elastic potential energy, and upon a disengagement of said extension ring of said lower ferrule from said hook portion of said opening controller, said tensioning spring will be restored to raise said middle shaft and said middle ferrule for extending said rib assembly for opening said umbrella; and said tip cap generally cylindrical shaped having an elongate notch formed in said cap to be slidably engaged with an extending base portion formed on said grip for forming a push button pivotally formed in said base portion, said cap having two protrusions formed inside the cap adjustably engaged with two elongate slots formed in said grip, said tip cap being operatively moved upwardly for shielding a plurality of tips of said rib assembly, said push button operatively depressing said opening controller and said closing controller.

5. An automatic umbrella according to claim 4, wherein said tip cap is slidably held in a bottom sleeve formed on a bottom portion of said grip.

* * * * *